United States Patent [19]

Yamashita et al.

[11] Patent Number: 4,698,948

[45] Date of Patent: Oct. 13, 1987

[54] FURNACE WALL CONSTRUCTION FOR INDUSTRIAL USE

[75] Inventors: Mitsuo Yamashita; Akinori Koda, both of Oumi, Japan

[73] Assignee: Denki Kagaku Kogyo Kabushiki Kaisha, Tokyo, Japan

[21] Appl. No.: 884,319

[22] Filed: Jul. 11, 1986

Related U.S. Application Data

[63] Continuation of Ser. No. 500,734, Jun. 3, 1983, abandoned.

[30] Foreign Application Priority Data

Jun. 10, 1982 [JP] Japan ..... 57-85373[U]
Jun. 25, 1982 [JP] Japan ..... 57-109537[U]

[51] Int. Cl.[4] ..... F27D 1/00; E04B 1/80; E04B 1/38; E04C 1/40

[52] U.S. Cl. ..... 52/410; 52/509; 52/512; 52/612; 110/336; 411/82; 411/258; 411/909

[58] Field of Search ..... 52/612, 512, 506, 404, 52/410, 509; 110/338, 336; 411/82, 258, 904

[56] References Cited

U.S. PATENT DOCUMENTS

| | | | |
|---|---|---|---|
| 1,448,684 | 3/1923 | Beecher et al. | 52/612 |
| 2,281,003 | 4/1942 | Henson et al. | 52/612 |
| 2,412,744 | 12/1946 | Nelson | 52/410 X |
| 2,559,763 | 7/1951 | Ginder et al. | 52/612 |
| 3,523,395 | 8/1970 | Rutter et al. | 52/506 X |
| 3,606,722 | 9/1971 | Fitzpatrick | 52/612 |
| 3,636,674 | 1/1972 | Cremer | 52/509 |
| 3,832,815 | 9/1974 | Balaz | 52/404 X |
| 3,930,916 | 1/1976 | Shelley | 52/506 X |
| 4,030,261 | 6/1977 | Coleman | 52/410 X |
| 4,379,382 | 4/1983 | Sauder | 52/506 |
| 4,429,504 | 2/1984 | Hounsel | 52/506 |
| 4,432,289 | 2/1984 | Norman et al. | 110/338 |
| 4,574,995 | 3/1986 | Sauder et al. | 110/336 |

FOREIGN PATENT DOCUMENTS

| | | | |
|---|---|---|---|
| 2231658 | 1/1973 | Fed. Rep. of Germany . | |
| 2065867 | 8/1971 | France | 52/512 |
| 2239572 | 7/1973 | France | 52/612 |
| 10015 | 1/1982 | Japan | 110/338 |

*Primary Examiner*—Alfred C. Perham
*Attorney, Agent, or Firm*—Jordan and Hamburg

[57] ABSTRACT

According to the invention a multi-layered furnace wall construction for industrial use is provided. The wall construction comprises an outermost iron shell layer, an innermost refractory fiber block layer and an intermediate layer interposed between the iron shell layer and the refractory fiber block layer. The refractory fiber block layer is secured to the intermediate layer by means of stud bolts and washers of ceramic material. The fibers constituting said refractory fiber block layer are oriented such that they extend in the direction substantially perpendicular to the surface plane of the furnace wall.

9 Claims, 4 Drawing Figures

FURNACE WALL CONSTRUCTION FOR INDUSTRIAL USE

This application is a continuation of application Ser. No. 500,734, filed June 3, 1983, now abandoned.

BACKGROUND OF THE INVENTION

1. Field of the Invention

The present invention relates to a furnace wall construction for industrial use, and particularly to a multi-layered furnace wall construction comprising an innermost layer made of blocks of refractory fibers.

2. Prior Art

In the conventional furnaces of industrial uses, for example heating and forging furnaces used in the steel-making industry or heating furnaces for general purposes used in other fields of art, the internal surface of the furnace wall is covered with refractory fibers, such as ceramic fibers, to improve the heat insulating function of the furnace wall. In the process for covering the inner wall surface of an industrial furnace, it is a common practice to use refractory fiber blocks which are secured over the surface of the furnace wall made of a non-fibrous material, such as plastics refractories, using a refractory mortar as the adhesive. Although the refractory fiber blocks may be easily applied on the wall of the furnace, this known practice is unsatisfactory for the reason that the refractory fiber blocks are not reliably secured on the wall but are susceptible to separation from the wall. Particularly, when the refractory fiber blocks are cemented on the ceiling of a furnace using a refractory mortar as the adhesive, almost all fiber blocks are separated and fall down from the ceiling within one or two months. Thus, this known practice is far from the one which can be recommended as a reliable and satisfactory manner for applying the refractory fiber blocks, on the furnace wall.

A multi-layered furnace wall construction is known, wherein a plurality of stud bolts made of a metal, such as stainless steel or steel, is secured to an iron shell forming the outer contour of a furnace, with the ends of the stud bolts extending inward of the furnace through a rock wool layer applied on the inner surface of the iron shell and a ceramic fiber layer superimposed on the inner side of the rock wool layer, and the ceramic fiber layer is fastened by metal washers fixed to the free ends of respective stud bolts. However, this known furnace wall construction is not suited for constructing a furnace which is exposed to a relatively high temperature, because the furnace wall of this type is not durable under a high temperature condition due to shrinkage of ceramic fibers and oxidation of stud bolts and washers made of a metal. It has been proposed to improve the furnace wall construction of this type by further providing, inward of the aforementioned ceramic fiber layer, a layer of crystallized aluminous fibers (felt form) which withstand a higher temperature environment and by substituting stud bolts and washers of ceramic composition for the metallic stud bolts and washers. However, the improved furnace wall construction in accordance with the former-made proposal has a disadvantage that the crystallized aluminous fiber layer (felt) is cracked due to shrinkage to fall down from the wall when the furnace temperature is raised higher. Moreover, in all of the known furnace wall constructions described above, ceramic fibers and/or crystallized aluminous fibers are oriented generally in the direction parallel to the surface plane of the furnace wall (the lining of this type will be referred to as layer lining). When the layer lining is exposed to hot combustion air flow blown from a burner or the like, the fibers at the surface portion of the lining are peeled off, the peeling occurring along the parallel orientation direction, so that the lining layer becomes thinner to result in loosening of the fastening force applied by the stud bolts, leading to fall-down of a mass of fiber block. Furthermore, development of cracking causes immediate draggling or partial separation of the lining layer.

In a further known furnace wall construction, a plurality of L-shaped studs made of a metal, such as stainless steel or steel, is secured to an iron shell forming the outer contour of a furnace, with the L-shaped free ends of the studs extending inward of the furnace for piercing corresponding fibrous refractory blocks in which fibers constituting the refractory blocks are oriented in the direction perpendicular to the surface plane of the furnace wall (the lining of this type will be referred to as stack lining). In this stack lining construction, a plurality of fibrous refractory blocks is stacked inside of the iron shell while allowing the fibers constituting the fibrous refractory blocks to extend perpendicular to the surface plane of the iron shell wall, the one end face of each fibrous refractory block engaging with the inside surface of the iron shell and the other end face of the block forming free end constituting the inner wall surface of the furnace. With this construction, even when crackings are caused by shrinkage at some portions of the innermost surface of the lining under the influence of heating, immediate separation of the lining block carried by the L-shaped studs does not occur. However, in the known stack lining construction, since the fibrous refractory blocks must be arranged such that the fibers contained in each refractory are oriented in the direction perpendicular to the surface plane of the iron shell, the entire mass of the lining from the innermost surface thereof to the low temperature portion engaging with the inside face of the iron shell must be made of crystallized aluminous fibers which withstand a higher temperature environment. Such a construction is uneconomical, because the crystallized aluminous fiber material is expensive.

OBJECT AND SUMMARY OF THE INVENTION

A primary object of this invention is to provide a multi-layered furnace wall construction for industrial use in which heat-resistant refractory fiber blocks are firmly secured on the innermost surface of the furnace in a stable condition without the fear that they are separated from the furnace wall for a long life time.

Another object of this invention is to provide a furnace wall construction for industrial use which may be durably used in a high temperature environment for a long time.

A further object of this invention is to provide a furnace wall construction for industrial use having a ceiling on which refractory fiber blocks are firmly secured without the fear that they are separated from the ceiling.

A still further object of this invention is to provide a multi-layered furnace wall construction for industrial use in which refractory fiber blocks are arranged on the innermost surface of the furnace in an economical manner to decrease the investment cost for constructing the furnace.

Yet a further object of this invention is to provide a multi-layered furnace wall construction for industrial use in which refractory fiber blocks are secured on the innermost surface of the furnace in a simple manner.

Another object of this invention is to provide a furnace wall construction for industrial use which permits easy access for repair.

The above and other objects of the present invention will be more clearly understood from the following description.

The present invention provides a multi-layered furnace wall construction for industrial use, comprising an outermost iron shell layer, an innermost refractory fiber block layer and an intermediate layer interposed between said iron shell layer and said refractory fiber block layer, said fiber block layer being secured to said intermediate layer by means of stud bolts and washers of ceramic material, the fibers constituting said refractory fiber block layer being oriented such that they extend in the direction substantially perpendicular to the surface plane of the furnace wall.

DESCRIPTION OF PREFERRED EMBODIMENTS

Figure 1:
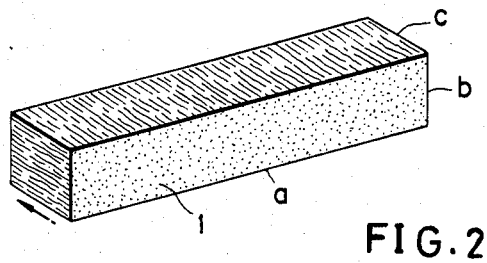
FIG. 1 is a perspective view of a refractory fiber block which is used in the furnace wall construction according to the present invention.

FIG. 1 shows a refractory fiber block 1 which is incorporated in the furnace wall construction of the present invention to form the refractory fiber block layer. The block 1 is constituted of fire-resistant fibers, such as ceramic fibers, aluminous fibers, particularly crystallized aluminous fibers, zirconia-base fibers and magnesia-base fibers and mixtures thereof. The ceramic fibers used in the present invention are amorphous fibers composed of 45 to 55 wt % of $Al_2O_3$ and the balance of $SiO_2$ and impurities inevitably contained in the composition. The crystallized aluminous fibers are composed of 70 to 98 wt % of $Al_2O_3$ and the balance of $SiO_2$ and/or MgO with some contaminating impurities inevitably contained in the composition, and have the crystal structure of mullite, spinel and $\alpha$-alumina or intermediate alumina. These fire-resistant fibers may be processed through the wet or dry process to form felt or blanket which is cut to form refractory fiber blocks of square pillar shape.

The letters a, b and c indicate the lengths of the sides of the block, the length a ranging from 300 to 600 mm, the length b ranging from 25 to 100 mm and the length c ranging from 50 to 150 mm in an exemplified block. The arrow in FIG. 1 shows the direction along which the fibers are oriented. The fibers constituting the refractory fiber block to be incorporated in the furnace wall constructed according to the present invention extend in the direction shown by the arrow in FIG. 1.

Figure 2:
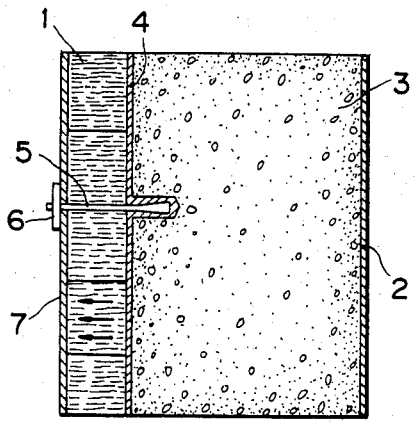
FIG. 2 is a sectional view of one embodiment of the invention, showing schematically a portion of the furnace wall constructed in accordance with the invention.
Figure 4:
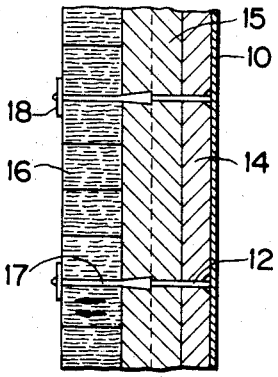
FIG. 4 is a sectional view of another embodiment of the invention, showing schematically a portion of the furnace wall constructed in accordance with the invention.

A plurality of the blocks 1 are assembled to construct the furnace wall constructions shown in FIGS. 2 and 4.

The embodiment of the furnace wall construction shown in FIG. 2 will be described. The furnace wall construction of this embodiment comprises an iron shell 2, a layer 3 of non-fibrous refractory material, such as plastics refractories, fire bricks, castable refractories and heat-insulating bricks, disposed internally of the iron shell 2, a refractory mortar layer 4 applied on the inside surface of the layer 3, a fiber block layer made of stacked fiber blocks 1, and a layer 7 of coating material applied on the inside surfaces of the fiber blocks 1. The fiber blocks 1 are securely supported by stud bolts 5 each having one end coated or surrounded by the refractory mortar 4 and fixedly buried in the non-fibrous refractory material layer 3. The stud bolts 5 may extend along the interfaces of the adjacent fiber blocks, as shown in the appended Figures, or may pierce through the fiber blocks to fixedly support the blocks.

Figure 3:
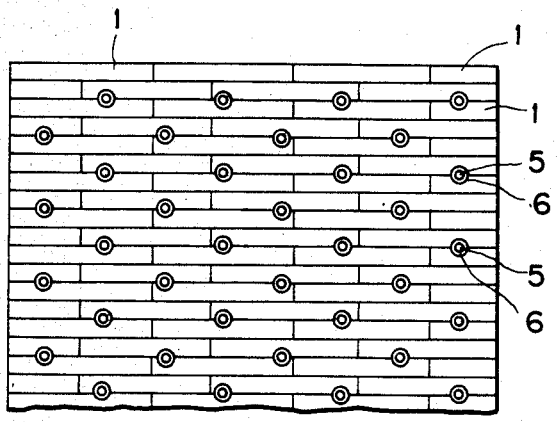
FIG. 3 is a front view of a ceiling of a furnace having a construction similar to that shown in FIG. 2 except in that no coating material is applied on the innermost surface.

It is preferred to support the blocks 1 by the studs bolts 5 extending along the interfaces of the adjacent fiber blocks 1 in order to save excess time and labor otherwise necessitated when the blocks are supported by stud bolts 5 piercing through the body portions of the blocks 1. However, the blocks 1 may be supported by the stud bolts 5 piercing through the body portions thereof to form a stacked furnace wall construction having a similar performance characteristics in practical operation of the furnace. The fiber blocks 1 are secured on the inside surface of the non-fibrous refractory material layer 3 by coating the refractory mortar 4 over the side faces of the blocks formed by cutting the fibers in the direction perpendicular to the fiber orientation direction (shown by the arrow in FIG. 1) and then putting the blocks against the inside surface of the non-fibrous refractory material layer 3. As best shown in FIG. 3, the blocks 1 are stacked to cover the inside surface of the layer 3 by stuffing them in-between the arrays of stud bolts 5. After the blocks 1 are secured to the layer 3 to cover overall surface of the latter, washers 6 are fixed to the ends of the stud bolts 5. The surface of the refractory fiber block layer 1 may be coated with a ceramic coating material 7, for example an alumina-silica base coating material, to increase the hardness of the surface of the fiber block layer 1 and to improve the wind-flap resistance for withstanding the blowing combustion air flow from a burner. However, the provision of this coating material layer 7 is not essential in the furnace wall construction of the invention. Since the refractory mortar 4 is coated on the side face formed by cutting the fibers perpendicular to the orientation direction thereof, the fiber block layer 1 is cemented to the non-fibrous refractory material layer 3 strongly. If the blocks 1 are cemented by coating the mortar 4 on the side surfaces on which the fibers extend parallel with each other, the adhesive force between the fiber blocks 1 and the layer 3 is adversely decreased. Since the fibers constituting the refractory fiber block layer 1 are oriented substantially perpendicular to the plane of the furnace wall surface, according to the present invention, there is no risk that fibers at the surface of the fiber block 1 are successively scaled off to result in separation of fiber blocks even if no coating material is applied on the inside surface of the fiber block layer 1 or even when the applied coating material is peeled off to expose the end faces of some fiber blocks 1 to the interior environment in the furnace.

The stud bolts 5 and the washers 6 are made of a ceramic material. The ceramic materials suited for this purpose include aluminous materials, alumina-silica base materials, silicon carbide base materials and silicon nitride base materials, and the silicon nitride base materials are preferred because they have improved thermal resistance and heat shock resistance.

In the furnace wall construction used as a side wall of a furnace, the stud bolts are arranged generally in a zig-zag fashion with the stud bolts forming either one of the horizontal or vertical array being spaced by 300 mm intervals and the stud bolts forming the other one of the vertical or horizontal array being spaced by 450 mm intervals. In the furnace wall construction used as a ceiling of a furnace, it may be a standard arrangement to arrange the stud bolts in a zig-zag fashion as shown in FIG. 3 with the stud bolts forming both of the longitudinal and transverse arrays being spaced by 300 mm intervals. However, the spacing between the adjacent stud bolts is not critical and may be varied depending on the condition in use. For example, if a damaged furnace having a non-fibrous refractory material layer 3, the inside surface of which has become rough to have significant undulation, is repaired by stacking the fiber blocks to cover the undulated inside surface of the layer 3, it is desirous that the spacing between the adjacent stud bolts be decreased to prevent the stacked refractory fiber blocks from separation. On the other hand, when the inside surface of the layer 3 is substantially flat, the spacing or pitch of the stud bolts 5 may be increased by about two times as long as the pitch of the standard arrangement.

In a particular embodiment used in a soaking pit furnace installed in a system for rolling a steel ingot, the side walls and the ceiling wall of the furnace including the heating zone and the soaking pit zone were formed by stacking over the inside surface (the surface exposed to high temperature environment) of a plastic refractory material layer 3, a plurality of square-pillar-shaped aluminous fiber blocks 1 each having a bulk density of 0.1, dimensions of 50 mm×50 mm×450 mm and composed of 80% of alumina and 20% of silica, the fibers constituting each pillar-shaped block being oriented similar to that shown in FIG. 1. The blocks 1 were cemented by a refractory mortar 4 and supported by stud bolts 5 arranged in a zig-zag fashion, with the horizontal arrays of the bolts spaced apart by 300 mm pitches and with the vertical arrays of the bolts spaced apart by 450 mm pitches for the side walls, and with the longitudinal arrays of the bolts spaced apart by 200 mm pitches and with the transverse arrays of the bolts spaced apart by 300 mm pitches for the ceiling wall. The thus stacked aluminous fiber blocks were fixedly secured by washers 6 attached to the ends of respective bolts 5. The stud bolts 5 and the washers 6 used for the fixation of the blocks 1 were made of silicon nitride, and the refractory mortar 4 used as the adhesive cement was a mullite structure material ($Al_2O_3$: 90%, $SiO_2$: 10%) which was coated to form a 3 to 4 mm thick adhesive layer.

The heating furnace constructed as aforementioned has been operated for one year in safety without separation of the applied refractory fiber blocks.

In contrast thereto, in the ceiling wall constructed in accordance with the conventional technology by cementing similar 300 mm×300 mm×50 mm blocks made of the same aluminous fibers using a refractory mortar, the number of the separated blocks amounted to approximately half of the applied blocks within one month. For the side wall constructed in accordance with the conventional technology using the same blocks and mortar cement, a number of applied blocks was separated within a half year.

It will be seen by comparing the results referred to above, that the furnace wall construction of the invention is improved over the prior art furnace wall construction in reliability and durability.

Another embodiment of the furnace wall construction according to the present invention is shown in FIG. 4. The furnace wall construction of this embodiment withstands a high temperature environment of up to 1500° C. As shown in FIG. 4, this embodiment comprises an iron shell 10, a rock wool layer 14 disposed internally of the iron shell 1, a ceramic fiber blanket layer 15 disposed internally of the rock wool layer 14, a layer 16 formed of a plurality of square pillar blocks made of crystallized aluminous fibers, a plurality of pins 12 made of a metal, such as stainless steel or steel, secured to and extending inwards from the iron shell 11, a plurality of ceramic stud bolts 17 each having one end connected to the end of the corresponding metal pin 12 at the position intermediately of the ceramic fiber blanket layer 15, and a plurality of ceramic washers 18 attached to the other ends of the ceramic stud bolts 17 for securing the layer 16. The square pillar blocks 16 made of crystallized aluminous fibers are stacked such that the fibers constituting the blocks 16 are oriented substantially perpendicular to the plane of the furnace wall surface while being somewhat compressed by the ceramic stud bolts 17. Similarly to the embodiment shown in FIG. 2, the crystallized aluminous fiber blocks 16 are stacked so that the fibers constituting each block 16 are oriented substantially perpendicular to the plane of the furnace wall surface, i.e. the fibers extending in the direction shown by the arrows in FIG. 4, in order to obviate adverse scale-off of the fibers. That is, there would be peeled off cracked surface portions developed by shrinkage due to heating if the blocks were stacked with the fibers oriented substantially parallel to the plane of the furnace wall surface.

The crystallized aluminous fiber blocks used in this embodiment have generally square pillar shapes similar to that shown in FIG. 1, and may be prepared by cutting a felt or mat made of crystallized aluminous fibers having a bulk density of 0.10 to 0.15. The thickness of the rock wool layer 14, the ceramic fiber blanket layer 15 and the crystallized ceramic fiber block layer 16 may be determined depending on the target temperature of the iron shell 10 set by the designer in view of the temperature within the furnace. For example, the thickness of the layer 16 may be determined so that the temperature of the layer 15 is maintained below 1100° C., and the thickness of the layer 15 may be determined so that the temperature of the layer 14 is maintained below 600° C. In an exemplified design of a heat insulating wall construction wherein the temperature within the furnace is 1300° C. and the temperature of the iron shell is set to 105° C., the thickness of the rock wool layer 14 is 50 mm, the thickness of the ceramic fiber blanket layer 15 is 100 mm and the thickness of the crystallized aluminous fiber block layer 16 is 75 mm, so that the total thickness of the insulating layers in the furnace amounts to 225 mm. The layers of rock wool, ceramic fiber and crystallized aluminous fiber are fixedly secured in position by means of ceramic stud bolts, ceramic washers and metal pins. One each of each metal pin 12 may be welded to the iron shell 10, and the corresponding ceramic stud bolt 17 is screwed into the other end of each metal pin 12. Each ceramic stud bolt 17 is fitted with the ceramic washer 18. The lengths of each ceramic stud bolt 17 and each metal pin 12 may be varied depending on the thickness of the composite insulating layer 14, 15 and 16 to provide a combined stud bolt couple having a length slightly longer than the thickness of the composite insulating layer. In general, a ceramic stud bolt 17 having a length of 150 mm or 100 mm is selectively used in view of the temperature within the furnace. The metal pins 12 are generally made of stainless steel or a heat-resistant steel.

The stud bolts are arranged to form arrays similar to those illustrated in FIG. 3 for the first embodiment. The crystallized aluminous fiber blocks 16 may be secured more reliably by implanting the stud bolts closer. However, this causes undesirable increase in cost induced by the increase in number of the stud bolts per unit area and by the increase in labor cost required for the implantation of the stud bolts. However, the stud bolts may be arranged closer to secure the crystallized aluminous fiber blocks 16 more reliably when the furnace wall construction of the invention is applied for a furnace exposed to vigourous vibration or a movable part, such as a door, of the furnace.

In this embodiment, the crystallized aluminous fiber blocks 16 are stacked while being compressed by the stud bolt arrays. For example, the crystallized aluminous fiber blocks 16 may be stacked between the stud bolts 17 under a condition such that the thicknesses of the blocks are decreased by 6 to 20%. The reaction force developed in each block against the compression stress facilitates reliable assembly, so that the stacked blocks are fixedly secured between the arrays of the stud bolts to prevent from separation or falldown. According to an exemplified design, fiber blocks are stacked so that each block is compressed to change its thickness from 55 mm to 50 mm. In another example, four crystallized aluminous fiber blocks 16 each having a thickness ranging from 53 to 60 mm are put in-between the arrays of stud bolts spaced by 200 mm to compress the blocks to have the thicknesses decreased by 6 to 20%. In the embodiment shown in FIG. 2, the blocks 1 may be stacked while being compressed, as well.

In the furnace wall construction of this embodiment, expensive crystallized aluminous fibers are used only in the zone exposed to high temperature to reduce the construction cost. Moreover, a plurality of crystallized aluminous fiber blocks of generally square pillar shape is stacked between the ceramic stud bolts under the compressed condition with the fibers constituting each block being oriented substantially perpendicular to the plane of the furnace wall surface to provide a heat-insulating wall construction for an industrial furnace in which the fibrous refractory materials are firmly secured without the fear of easy separation. By the use of crystallized aluminous fibers which withstand a high temperature environment, the heat-insulating wall construction according to this embodiment may be incorporated in an industrial furnace operated at an inner temperature ranging from 1200° to 1500° C.

The side walls and ceiling of an industrial furnace for heating steel imgots, in which the maximum temperature within the furnace reached 1400° C. and the average operation temperature was 1350° C., were applied with the insulating wall construction of this embodiment, and the furnace was operated for one year without any accident or mulfunction with the result that the saved energy amounted to about 20% when compared to the energy consumed in the conventional furnace applied with a prior art plastics refractory material.

The inside surface of the crystallized aluminous fiber block layer of the furnace wall construction according to this embodiment may be covered with a coating material, such as an alumina-silica base coating material, commonly used for coating the furnace wall surface of the conventional stack lining type furnaces. The durability of the insulating wall structure may be further improved in some cases. However, the furnace wall construction according to this invention, has a sufficient durability well suited for some applied uses. Accordingly, the furnace wall construction of the invention is not essentially coated with a coating material.

As has been described hereinbefore, the furnace wall construction according to either one of the illustrated embodiments of the invention comprises a fibrous refractory material and can be applied for a furnace exposed to a higher temperature environment without a fear of separation or cracking of the refractory material to satisfy the demands for saving energies and natural resources.

Although the present invention has been described with reference to the preferred embodiments, it should be understood that various modifications and variations can be easily made by those skilled in the art without departing from the spirit of the invention. Accordingly, the foregoing disclosure should be interpreted as illustrative only and not to be interpreted in a limiting sense. The present invention is limited only by the scope of the following claims.

What is claimed is:

1. A multi-layered furnace wall construction for industrial use, comprising an outermost iron-shell layer, an innermost refractory fiber block layer comprised of a plurality of refractory fiber blocks, and an intermediate layer interposed between said iron shell layer and said refractory fiber block layer, said refractory fiber block layer being secured to said intermediate layer by means of stud bolts and washers of ceramic material, each of the stud bolts being situated in a joint between adjacent ones of said refractory fiber blocks and having a free and extending away from the interior faces of the refractory fiber blocks, each of the free ends receiving a respective one of the washers adjacent the interior faces of the refractory fiber blocks, so that said refractory fiber blocks are compressed between said stud bolts in a direction substantially parallel to the surface plane of the furnace wall and secured in a direction perpendicular to the furnace wall, and the fibers constituting said refractory fiber block layer being oriented such that they extend substantially perpendicular to the surface plane of the furnace wall.

2. The multi-layered furnace wall construction according to claim 1, further comprising a refractory mortar layer interposed between said intermediate layer and said refractory fiber block layer for cementing the fibers of said refractory fiber layer to said refractory mortar layer.

3. The multi-layered furnace wall construction according to claim 2, wherein the end portions of said stud bolts thrusting into said intermediate layer are coated with said refractory mortar layer.

4. The multi-layered furnace wall construction according to claim 2, wherein said intermediate layer is made of a material selected from the group consisting of plastics refractories, fire bricks, castable refractories, heat-insulating bricks and combinations thereof.

5. The multi-layered furnace wall construction according to claim 2, wherein the interior surface of said refractory fiber block layer is covered with a lining layer of ceramic coating material, the interior of said refractory fiber block layer being free of said ceramic coating material.

6. The multi-layered furnace wall construction according to claim 1, wherein said intermediate layer includes a rock wool layer arranged internally of said iron shell layer, and a ceramic fiber layer arranged internally of said rock wool layer, and wherein said refractory fiber block layer is made of crystallized aluminous fibers.

7. The multi-layered furnace wall construction according to claim 6, wherein the interior surface of said refractory fiber block layer is covered with a lining layer of ceramic coating material, the interior of said refractory fiber block layer being free of said ceramic coating material.

8. The multi-layered furnace wall construction according to claim 1, wherein each of said stud bolts is connected to a metal pin fixed to said iron shell layer, said metal pin extending into said intermediate layer.

9. The multi-layered furnace wall construction according to claim 1, wherein said refractory fiber block layer is made of a fibrous material selected from the group consisting of ceramic fibers, aluminous fibers, zirconia-base fibers, magnesia-base fibers and mixtures thereof.

* * * * *